United States Patent [19]

Adelhardt et al.

[11] 4,206,889

[45] Jun. 10, 1980

[54] COIL UNWINDING DEVICE

[75] Inventors: Georg Adelhardt; Karl Buettner; Walter Feichtner, all of Nuremberg; Herbert Hasselberg, Lauf; Andreas Voelkel, Nuremberg, all of Fed. Rep. of Germany

[73] Assignee: Kabel-und Metallwerke Gutehoffnungshuette AG, Fed. Rep. of Germany

[21] Appl. No.: 4,334

[22] Filed: Jan. 18, 1979

[30] Foreign Application Priority Data

Feb. 9, 1978 [DE] Fed. Rep. of Germany ..... 2805346

[51] Int. Cl.[2] ..... B65H 49/00

[52] U.S. Cl. ..... 242/128; 242/72 R

[58] Field of Search ..... 242/128, 129, 130, 130.1, 242/68.2, 72

[56] References Cited

U.S. PATENT DOCUMENTS

| | | | |
|---|---|---|---|
| 2,842,323 | 7/1958 | Rayburn | 242/128 |
| 2,930,542 | 3/1960 | Cocker | 242/130 |

FOREIGN PATENT DOCUMENTS

| | | | |
|---|---|---|---|
| 2805346 | 12/1978 | Fed. Rep. of Germany | 242/128 |
| 1460417 | 10/1966 | France | 242/128 |
| 120770 | 6/1927 | Switzerland | 242/128 |

*Primary Examiner*—Leonard D. Christian
*Attorney, Agent, or Firm*—James C. Jangarathis

[57] ABSTRACT

A device for unwinding elongated material from a coil which includes a plate which is placed on top of the coil, with the plate including a rotatable guide means for guiding unwound material, and at least two elongated arcuate members which extend into the coil interior and define a cylindrically shaped shell. The arcuate members are pivotally mounted to the plate, and are provided with a means which exerts a force against the arcuate members to press the arcuate members against the coil interior to hold the interior windings as the coil is unwound.

6 Claims, 3 Drawing Figures

Fig. 1
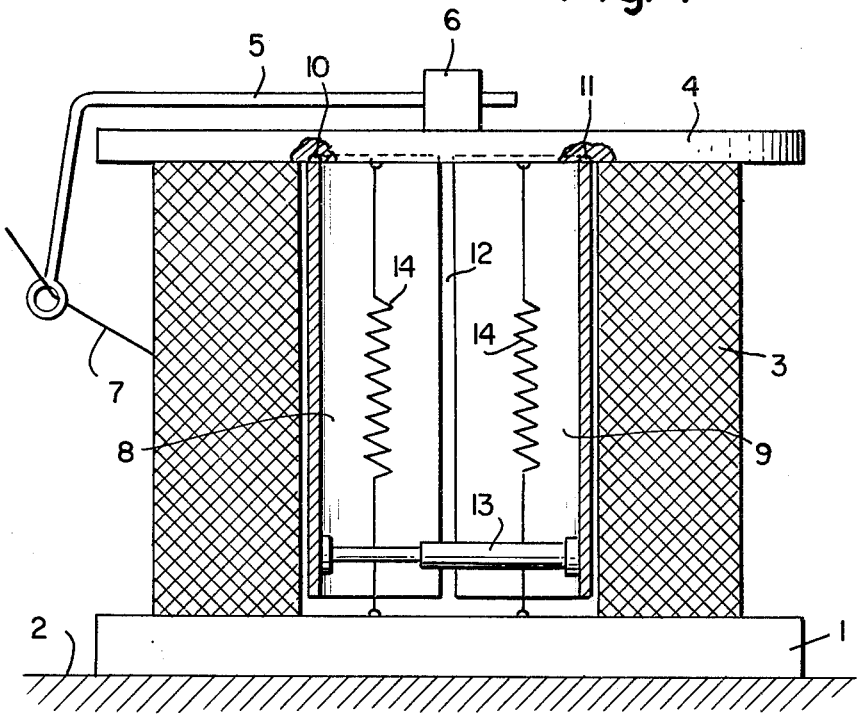
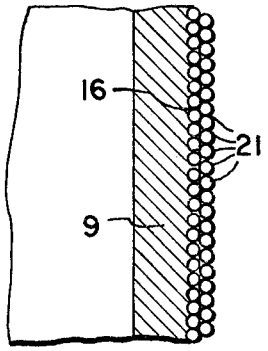
Fig. 2
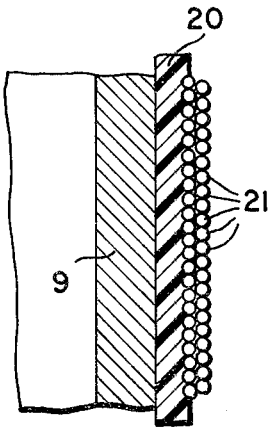
Fig. 3

COIL UNWINDING DEVICE

This invention relates to a device for unwinding elongated material from a wound coil.

Devices for unwinding an elongated material from a wound coil are employed, for example, for unwinding materials, such as cables, wires, conductors, etc. Such materials are usually wound on drums; however, as a result of the cost of such drums, the drums are generally constructed so that they can be removed from the coil at the end of the winding procedure whereby the coil has an unsupported hollow interior. The coil is generally held together by several tightening straps.

Elongated material may be unwound from such coils by the use of a device mounted above the coil which includes a rotating guide for the material to be unwound, referred to in the art as a "flyer". For unsupported coils, there is presently available a winding device which includes a plate for placement on top of the coil, with the plate including an unwinding guide (flyer), and a support which extends into the hollow interior of the coil to prevent the plate from falling when only a few coil windings remain. Such a device, however, has the disadvantage that as the diameter of the coil decreases, the stability of the coil decreases and the windings on the coil fall and snag with each other, resulting in tearing of the material. As a result, complete unwinding of the coil is not possible.

In accordance with the present invention, there is provided a device for unwinding elongated material from a wound coil which includes a plate for placement on the top end of the coil, with the plate including a guide means for guiding elongated material from the coil. The plate further includes at least two elongated arcuate members having one end thereof pivotally mounted to the plate, with the arcuate members defining a generally cylindrically shaped hollow shell for insertion into the interior of a wound coil. The arcuate members are further provided with a means to apply an outwardly pressing force thereto, whereby upon insertion of the arcuate members into the coil said arcuate members are pressed against the coil interior. The shell defined by the arcuate members supports the coil interior, and the pressure mechanism connected to the arcuate members continuously presses the members against the interior surface of the coil whereby the inner coil layers are maintained under a constant tension. As the stability of the coil decreases as a result of the reduced number of windings, the force applying mechanism, which is connected to the arcuate members adjacent the lower end thereof, forces said members outwardly so as to have the effect of an expanding arbor, whereby the shell gradually assumes a generally conical shape. The expanding arbor effect rigidly holds the interior windings of the coil so that they cannot fall down, thereby permitting full unwinding of the coil, without snagging.

The invention will be further described with respect to a preferred embodiment thereof illustrated in the accompanying drawing, wherein:

FIG. 1 is a simplified elevational view, partially in section, of an embodiment of the device of the present invention; and FIGS. 2 and 3 are partial sectional views of alternative modifications of the outer surfaces of the arcuate members incorporated in the device of the present invention Referring now to the FIGURE there is shown a coil 3 of wound elongated material which rests on a suitable substrate, such as a transport substrate; e.g., a pallette. The coil does not include an interior support, and is held together by a few tightening straps (not shown). The coil is arranged in a vertical position on the support 1.

The coil 3 is provided with an unwinding device in accordance with the present invention which includes a plate 4, preferably in the form of a circular disc, which rests on the top side of coil 3. The plate 4 is provided with a rotatable guide means 5 (flyer) which is rotatably mounted, as known in the art to guide wire 7 which is to be unwound from coil 3. A pair of elongated arcuate members 8 and 9 extend downwardly from plate 4 into the interior of coil 3, and are pivotally mounted on plate 4 through hinge-like bearings schematically indicated as 10 and 11. The arcuate members 8 and 9 define a generally cylindrically shaped hollow shell, with the members 8 and 9 being spaced from each other by diametrically opposed gaps 12 to permit relative movement therebetween. The lower ends of the arcuate members 8 and 9 are provided with a force exerting mechanism 13 by means of which the arcuate members, after being inserted into the coil 3, are continuously outwardly pressed against the interior surface of coil 3. The mechanism 13 can be a spring or suitable pneumatic or hydraulic device. The plate 4 is further provided with means for pressing the plate against the top of the coil 3, which can take the form of suitable tensioning springs 14 connected to the plate 4 and the support 1. The length of the members 8 and 9 should be somewhat shorter than the length of the coil 3 so that the coil 3 can be continuously pressed between the plate 4 and support 1.

In operation, the plate 4 is placed on top of coil 3, with the arcuate members 8 and 9 extending into the coil interior. The springs 14 are then adjusted so that the plate 4 is pressed against the top of coil 3. The force applying mechanism 13 is then activated so that the members 8 and 9 are outwardly pressed against the interior of the coil 3. The tightening straps (not shown) which hold the coil together can then be loosened, and the wires 7 unwound from the coil 3 through the guide means 5. As the stability of the coil decreases as the number of windings decreases, the coil is compressed in the axial direction by plate 4 through the action of springs 14. At the same time, the lower ends of members 8 and 9 are outwardly pressed against the interior of the coil 3 by mechanism 13, and function as an expanding arbor which assumes a generally conical shape. In this manner, the windings of the wires 7 are maintained under tension and do not fall down, whereby the coil can be effectively unwound without snagging thereof.

It is to be understood that various modifications of the hereinabove described embodiment are possible in light of the above teachings. Thus, for example, although the embodiment has been particularly described with respect to the use of two arcuate members, more than two members can be employed. As should be apparent, if more than two members are employed, the force applying mechanism must be appropriately modified so as to outwardly press such additional members. In such an embodiment, the members form a substantially cylindrical shell so that there is support all around the interior surface of coil 3.

The present invention may also be modified in a manner such that the outer surface of the arcuate members are provided with additional means for enhancing interior support of the coil. Thus, for example, the surface of the arcuate members in contact with the coil may include ring shaped grooves 16 of minimal depth for partially engaging the immediately adjacent individual windings 21 of coil 3, as illustrated in FIG. 2, or may comprise a compressible intermediate layer 20 such as polystyrene, into which the immediately adjacent individual windings 21 are partially embedded, as illustrated in FIG. 3.

The above modifications and others should be apparent to those skilled in the art.

Numerous modifications and variations of the present invention are possible in light of the above teachings and, therefore within the scope of the appended claims, the invention may be practiced otherwise than as particularly described.

We claim:

1. A device for unwinding elongated material from a wound coil having an opening interior, comprising:

a plate for placement on an end of the coil;

guide means mounted on the plate for guiding elongated material unwound from the coil;

a shell for insertion into the interior of a wound coil comprised of at least two elongated arcuate members, said arcuate members having one end thereof pivotally mounted to the plate; and means connected to said arcuate members to apply an outwardly pressing force to said arcuate members, whereby upon insertion into the coil said arcuate members are pressed outwardly against a coil interior.

2. The device of claim 1 wherein the plate includes means for maintaining the plate in contact with an end of the coil.

3. The device of claim 2 wherein the arcuate members have a length less than the length of the coil.

4. The device of claim 3 wherein said means for applying an outwardly pressing force to the arcuate members is adjacent the lower end of the arcuate members and forces said arcuate members outwardly during unwinding of the coil whereby the shell assumes a generally conical shape during unwinding to support the interior windings of the coil and permit full unwinding thereof.

5. The device of claim 4 wherein the surface of the arcuate members which is pressed against a coil includes means for enhancing interior support of a coil.

6. The device of claim 4 wherein the shell is a generally cylindrically shaped hollow shell comprised of two arcuate members which are separated from each other by diametrically opposed gaps.

* * * * *

UNITED STATES PATENT OFFICE

CERTIFICATE OF CORRECTION

Patent No. 4,206,889 Dated June 10, 1980

Inventor(s) Georg Adelhardt et al

It is certified that error appears in the above-identified patent and that said Letters Patent are hereby corrected as shown below:

Column 2, line 1, delete "the" and after "FIGURE" insert -- 1 -- ;

Column 3, Claim 1, line 22, "opening" should be -- open -- .

Signed and Sealed this

*Twelfth* Day of *August 1980*

[SEAL]

*Attest:*

SIDNEY A. DIAMOND

*Attesting Officer*

*Commissioner of Patents and Trademarks*